US008047861B2

(12) United States Patent
Ciriello et al.

(10) Patent No.: US 8,047,861 B2
(45) Date of Patent: Nov. 1, 2011

(54) ELECTRICAL CONNECTOR SYSTEM

(75) Inventors: Tommasino Ciriello, Venaria (IT); Thomas Schmidt, Nuremberg (DE)

(73) Assignee: FCI, Versailles (FR)

( * ) Notice: Subject to any disclaimer, the term of this patent is extended or adjusted under 35 U.S.C. 154(b) by 0 days.

(21) Appl. No.: 12/734,244

(22) PCT Filed: Oct. 22, 2007

(86) PCT No.: PCT/IB2007/055377

§ 371 (c)(1),
(2), (4) Date: Jun. 25, 2010

(87) PCT Pub. No.: WO2009/053778

PCT Pub. Date: Apr. 30, 2009

(65) Prior Publication Data

US 2010/0323545 A1 Dec. 23, 2010

(51) Int. Cl.
*H01R 13/52* (2006.01)

(52) U.S. Cl. ..... 439/271

(58) Field of Classification Search ..... 439/271
See application file for complete search history.

(56) References Cited

U.S. PATENT DOCUMENTS

| | | | | |
|---|---|---|---|---|
| 4,193,655 | A | 3/1980 | Herrmann, Jr. et al. | |
| 6,419,510 | B2 * | 7/2002 | Shiraki et al. | 439/188 |
| 2001/0027043 | A1 | 10/2001 | Shiraki et al. | 439/188 |

FOREIGN PATENT DOCUMENTS

| | | | |
|---|---|---|---|
| EP | 0 903 814 | A1 | 3/1999 |
| EP | 1 130 692 | A2 | 9/2001 |
| GB | 2 295 733 | A | 6/1996 |
| WO | WO 2006/068229 | A1 | 6/2005 |

* cited by examiner

*Primary Examiner* — Javaid Nasri
(74) *Attorney, Agent, or Firm* — Harrington & Smith

(57) ABSTRACT

The invention relates to electrical connector systems including a first connector provided with a plug-portion and a retainer adapted to act together with the plug-portion. The retainer further includes a sleeve portion which is adapted to be arranged in a mating connector socket and which is in turn adapted to receive at least a part of the plug-portion of the first connector therein. The connector system includes a first sealing member adapted to provide a sealing between the sleeve portion and inner walls of the mating connector socket; and a second sealing member, which is adapted to be arranged between the retainer and the first connector to provide a sealing between retainer and first connector.

7 Claims, 3 Drawing Sheets

ELECTRICAL CONNECTOR SYSTEM

1. FIELD OF THE INVENTION

The invention relates to an electrical connector system, in particular for airbag ignition systems, which is sealed against e.g. moisture and/or dust.

2. PRIOR ART

Electrical connectors for airbag ignition systems usually comprise a squib connector or plug connector and a squib holder or socket into which the squib connector can be inserted. The squib holder is usually provided with contact pins and belongs to the airbag ignition system. The squib connector in turn is connected to the airbag control system. Usually, the squib holder is a standardized element and designed and produced by a different manufacturer than the squib connector. The connector system consisting of a squib connector and a squib holder often further comprises a so-called retainer, which can be inserted into the squib holder, i.e. the socket. When the squib holder is a standardised element the retainer may serve as an adapter for the squib connector, such that identical squib connectors may be used with different squib holders, provided that a matching retainer is provided between squib holder and connector. Further, the retainer often contributes to a shorting function, to short circuit the pins of the squib holder when no electrical connection is established.

Document EP 1 130 692 A2 discloses an electrical connection system consisting of a squib connector, a squib holder and a shorting insert which is attached in the squib holder and which is adapted to receive a plug-in portion of the squib connector. However, the connector system according to EP '692 comprises no sealing members, such that the connector system disclosed is highly susceptible for intruding moisture or dust, which could effect the electrical connection, leading to potentially fatal malfunctions of the airbag system.

Prior art document WO 2006/068229 A1 tries to solve this problem by providing a ring shaped sealing member around the plug-in projection of the squib connector. When the squib connector is inserted into a corresponding squib holder, the sealing member contacts the upper rim of the mating holder, thereby establishing a sealed electrical connection. However, the upper surface of the mating holder is not defined in the standards, as it is the case for parts of the inner walls of the socket and the bottom of the same. Thus, the sealing effect provided by the solution of WO 2006/068229 A1 requires that the sealing member is adapted to the different upper surfaces of the various squib holders or sockets available. Thus, the sealing members have to be particularly designed for the various squib sockets necessitating a larger amount of different sealing members, thus increasing costs and complexity of the connector systems.

Therefore, an object of the present invention is to provide a connector system, which reduces or minimizes the above described problems and disadvantages and which leads to a secure sealing in connector systems comprising a retainer.

3. SUMMARY OF THE INVENTION

The above problem is solved by an electrical connector system according to claim 1.

The electrical connector system according to the invention is in particular suited for airbag ignition systems. It comprises a first connector, often referred to as squib connector, provided with a plug-portion, and comprises further a retainer adapted to act together with the plug-portion. The retainer comprises a sleeve portion, which is adapted to be arranged in a mating connector socket, often referred to as squib holder, and which sleeve portion is adapted to receive at least a part of the plug-portion of the first connector therein. To provide for a reliable sealing of the connector system, the system further comprises a first sealing member adapted to provide a sealing between the sleeve portion of the retainer and the inner walls of a mating connector socket. This is in particular advantageous when the inner walls of the mating connector socket, i.e. the squib holder, have a standardized size and shape as it is often the case. In this way it is possible to produce retainers, which are shaped on the outside to match with certain standardized mating connector sockets and which have their interior adapted to receive the plug-portions of certain squib connectors. In other words: the outer shape and thus the sealing elements of the retainer can be standardized matching the standardized connector sockets.

The connector system further comprises a second sealing member, which is adapted to be arranged between the retainer and the first connector to provide a sealing between retainer and first connector. In other words, the first sealing member provides e.g. a sealing between the outer walls of the sleeve portion and the inner walls of the mating connector socket and the second sealing member provides a sealing for example between the inner walls of the sleeve portion of the retainer and the outer walls of the plug-portion of the squib connector.

In one aspect of the invention the plug portion of the squib connector is provided with at least one resilient latching arm and the sleeve portion is provided in its interior with at least one corresponding latching recess, so that the plug portion can be latched inside of the sleeve portion. Most preferably, the plug portion is provided with two latching arms arranged symmetrically on two opposing sides of the plug portion and the sleeve is provided with corresponding recesses. To provide for a particular effective sealing, it is advantageous that the sleeve portion is dimensioned such that when it is arranged inside of a mating connector socket it extends from the bottom of the socket to essentially at least the outer rim of the socket, without any openings allowing the intrusion of e.g. moisture to the interior of the retainer respectively the retainer sleeve. In an advantageous embodiment the sleeve portion is further provided with fixing means on its outside walls, which are adapted to allow fastening of the sleeve portion inside the mating connector socket. This may for example be accomplished by means of resilient protrusions which may snap-fit into a corresponding recess or groove provided in the inner walls of the connector socket. However, also resilient latching arms may be provided on the sleeve portion, which latch into corresponding latching recesses provided in inner walls of the connector socket.

In an advantageous embodiment, the retainer sleeve is essentially cylindrical, i.e. it has in essentially cylindrical outer surface, and the first sealing member is an o-ring. The first sealing member may thus be arranged between the cylindrical outer wall of the retainer sleeve and the preferably cylindrical inner wall of the connector socket. In this case, it is advantageous, that the outer wall of the cylindrical retainer is provided with a circumferential sealing groove, to receive and hold the o-ring. This sealing groove facilitates the assembly of the electrical connector system, since it prevents the o-ring from getting lost.

In an embodiment, the second sealing member has essentially a u-shaped cross section and the retainer has a circular protruding rim, which extends into the inside of the u-shape, and wherein the sealing member is fitted such onto the protruding rim, that when the plug portion is inserted into the sleeve portion of the retainer at least one face of the u-shaped sealing member engages the first connector. With any of the above described embodiments, it is in particular advantageous, if the sealing of the connector systems is adapted to prevent dust and/or moisture from reaching the electrical connection, when first connector is connected with a mating connector socket. The invention provides particular advantages in the case of standardized mating connector sockets, because the retainer may serve as an adapter between the socket and the first connector respectively the plug portion of the first connector. With the invention it is possible to design retainer with a standardized outer shape having standardized sealing members, which provide a perfect sealing between the retainer and the standardized mating connector socket.

An advantage of particular embodiments of the invention is that the construction of the invention allows for the elastic force exerted by the first and second sealing members to act in a direction essentially perpendicular to the insertion direction of retainer and plug portion. Therefore, the assembly of retainer and plug portion, i.e. the plug-in process, is not hampered by the sealing members and at the same time, since the sealing members do not produce any substantial force acting against the insertion direction, the fixing of the different parts of the connector system with each other is not weakened over time by the sealing.

4. DESCRIPTION OF THE PREFERRED EMBODIMENTS

In the following, the invention is described exemplarily with reference to the enclosed figures, in which.

Figure 1:
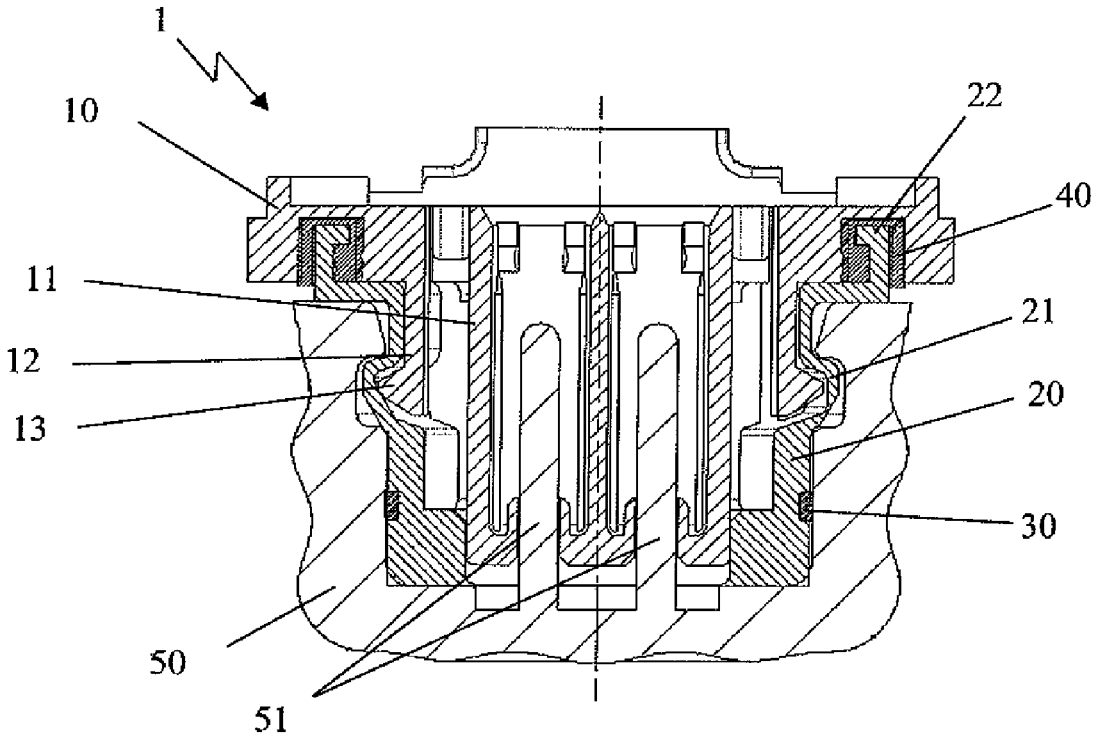
FIG. 1 is a front cross sectional view of an assembly of an electrical connector system according to the present invention.

FIG. 1 shows an embodiment of an electrical connector system according to the invention in a cross sectional front view. The connector system 1 comprises a first connector 10 in form of a squib connector, which is provided with a plug portion 11. The plug portion 11 is inserted into a retainer 20 which is in turn inserted into a mating connector socket 50, which may also be referred to as squib holder. The connector socket 50 comprises two contact pins 51, which are inserted through apertures provided in the bottom of plug portion 11. The plug portion 11 is in turn provided with mating female terminals (not shown), which connect the contact pins 51 to provide an electrical connection between first connector and connector socket. Inside of the connector socket 50 has advantageously essentially a cylindrical shape.

Figure 2:
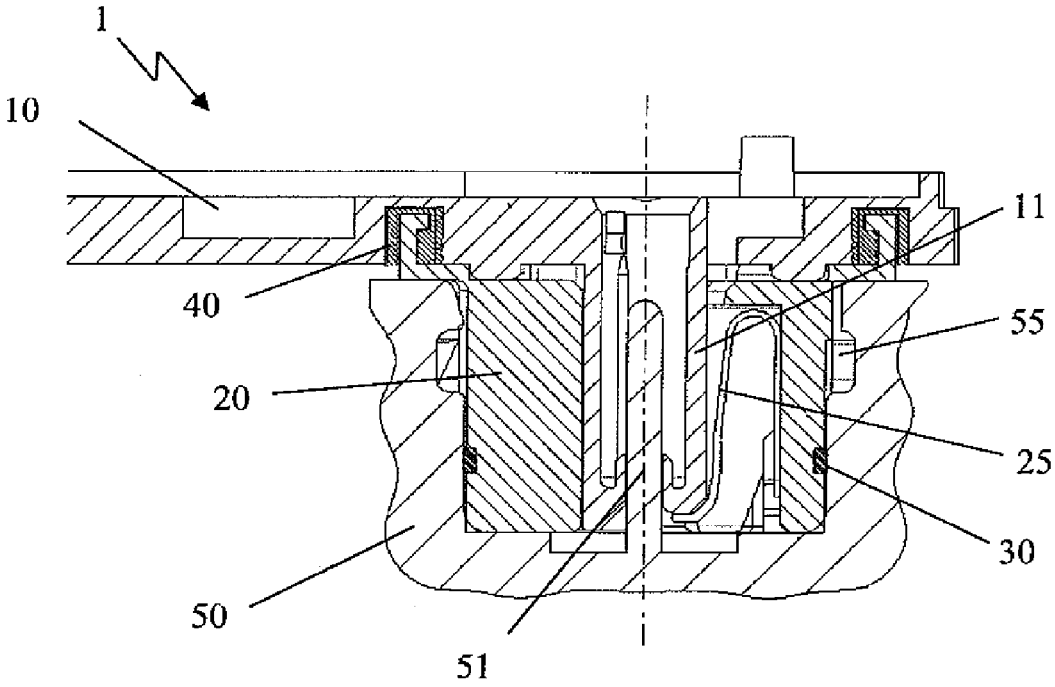
FIG. 2 is a side cross sectional view of the embodiment of FIG. 1.
Figure 3:
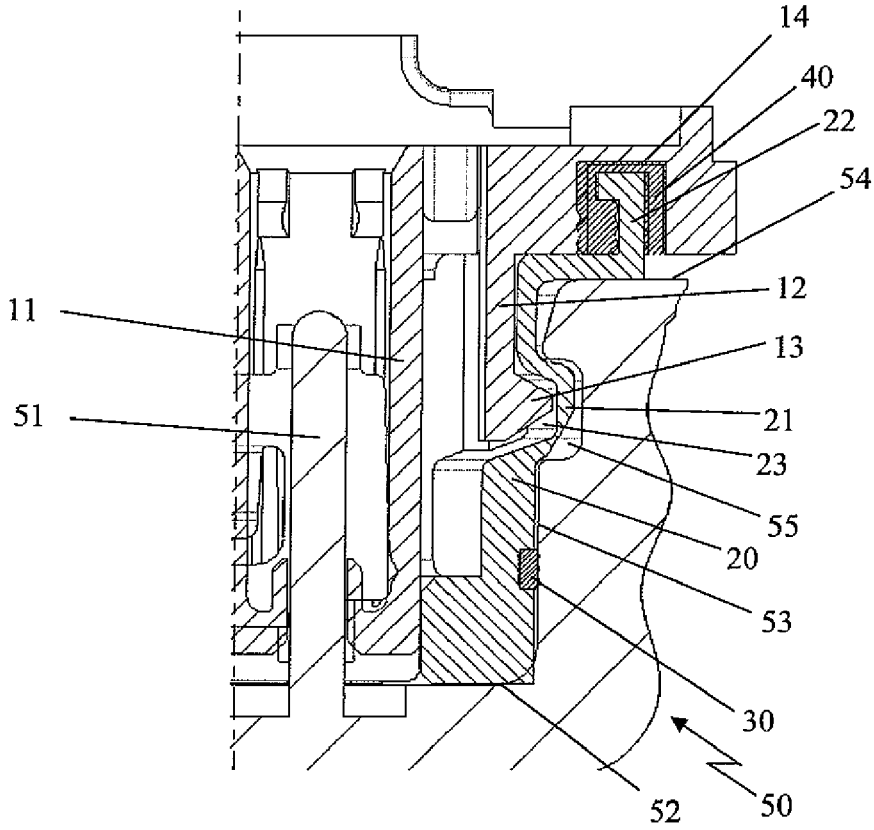
FIG. 3 is a detail of the right hand side of the embodiment shown in FIG. 1.

Now referring to FIG. 3, the connector socket 50 has a bottom 52, inner cylindrical walls 53 and an outer rim 54. The inner walls 53 are further provided with a circumferential groove 55 to accommodate fixing means of the retainer. As can be seen from FIG. 3, the retainer 20 is fully inserted into the connector socket 50 and extends essentially from the bottom 52 of the socket to the outer rim 54. The retainer comprises a sleeve portion, which could be considered as the cylindrical part of the retainer shown between the bottom 52 and the rim 54 of the socket. The walls of this sleeve portion between the positions of the first sealing member 30 and the second sealing member 40 do not contain any openings which allow intrusion of moisture and/or dust into the interior of the sleeve portion. The retainer sleeve is essentially cylindrical with a slightly smaller outer diameter than the inner diameter of the socket. The sleeve portion is further provided with fixing means 21 on its outside walls, which are adapted to allow to fasten the sleeve portion inside the mating connector socket. As can be seen from FIG. 3, the fixing means 21 consist essentially of a circumferential protruding bulge, which is accommodated in the groove 55 in the inner walls 53 of the socket. The bulge of the fixing means 21 is preferably shaped such that it is possible to press the retainer into the socket, whereby the bulge snap-fits into the groove upon full insertion of the retainer into the socket. The plug portion 11 of the first connector 10 is provided with two resilient latching arms 12 which are further provided with a latching lug 13 on their distal ends and the retainer is in turn provided with inner latching recesses 23, into which the latching lugs 13 of the latching arms 12 may be fitted. In the shown embodiments of FIGS. 1 to 6 the latching recess 23 of the retainer and the groove 55 of the connector socket are arranged at the same height. This allows a low size of the retainer; however, it is not mandatory, since recess 23 and groove 55 could also be offset with respect to the connexion axis. For assembly, first the retainer is fully inserted into the socket and after that the plug portion 11 is inserted into the retainer whereby the resilient latching arms 12 are first bend inwardly and then snap back into the latching recesses 23 upon full insertion of the plug portion into the retainer.

A first sealing member 30 is provided on the outer wall of the retainer sleeve close to the bottom of the same and provides a sealing between the outer wall of the retainer and the inner wall 53 of the connector socket. A second sealing member 40 is provided between a sealing surface of the first connector 10 and an outer rim 22 of the retainer. As the skilled person will note upon considering the embodiment shown in FIGS. 1 to 6, the sealing of the connector systems are adapted to prevent dust and/or moisture from reaching the electrical connection provided by the contact pins 51 and the corresponding female terminals in the first connector (not shown). It should be noted that in all the embodiments shown it is of course equally possible to invert the arrangement of contact pins 51 and corresponding female terminals, i.e. the pins could e.g. be provided in the first connector and the female terminals in the mating connector socket.

As can best be seen from FIG. 3, the outer wall of the sleeve portion of the retainer is provided with a circumferential sealing grove, into which the sealing member 30 is fitted. The second sealing member 40 has in turn an essentially u-shaped cross section and the retainer has a circular protruding rim 22 which is at least partially surrounded by the u-shaped second sealing member. Accordingly, also the housing of first connector 10 is provided with a circular grove 14 to accommodate the second sealing member. Thus, in the exemplary embodiments shown in the figures, the outer walls of the retainer and the inner walls of the socket are advantageously cylindrical, which is also true for the rim 22, the second sealing member 40, the corresponding grove 14 provided in the first connector and the portion of the first connector where the sealing is made. The plug-portion in turn needs not to be cylindrical but, as it can best be seen from FIG. 2 or 6, may have an essentially rectangular cross section, which is accommodated in a correspondingly shaped interior of the retainer.

In FIG. 2 a shorting member 25 is shown, which is arranged inside of the retainer 20. The shorting member 25 is adapted to short circuit the contact pins 51 of the mating connector socket when the retainer is arranged in the socket as shown in the figures. The shorting member 25 is provided in form of a resilient shorting clip, which contacts the contact pins 51 when the first connector 10 is not fully inserted into the retainer. By inserting the plug portion into the retainer the shorting clip is bent out of contact with the contact pins 51.

Figure 4:
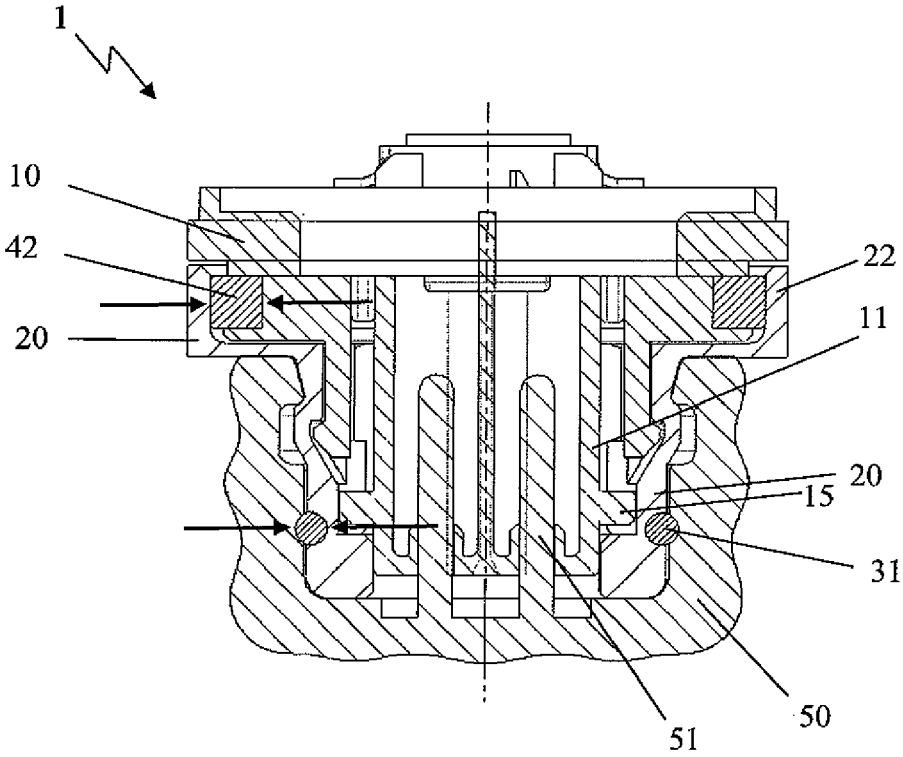
FIG. 4 is a front cross sectional view of another embodiment of the invention.

In FIG. 4 an alternative embodiment of the present invention is shown. In all the figures, similar reference numbers refer to similar parts of the connector system. The retainer 30 and connector 1 of FIG. 4 are basically the same as in the embodiments shown in FIGS. 1 to 3. Differences are that in FIG. 4 the first sealing member 31 is provided in form of an o-ring which provides a sealing between the outer walls of the retainer 20 and the inner walls of the connector socket 50 and that the second sealing member 42 is a circumferential ring having an essentially rectangular cross section. Similar to the embodiment of FIGS. 1 to 3 the second sealing member 42 is provided between a sealing surface of the first connector 10 and the outer rim 22 of the retainer. Thus, the second sealing member 42 provides a sealing between the retainer 20 and the connector 10. Again, the connector socket 50 is essentially cylindrical and the outer walls of the retainer or the retainer sleeves are correspondingly also cylindrical.

Advantageously the plug portion 11 has projections 15, located at the proximity of the bottom portion of plug portion and which when connector 10 is inserted into the retainer 20 provide for a supplementary sustaining at the retainer sleeve inner diameter, ensuring the pressure of first sealing member 30,31 against inner wall 53. Further those projections allow advantageously an easier positioning of first connector 10 when introducing into the retainer with socket 50.

Figure 5:
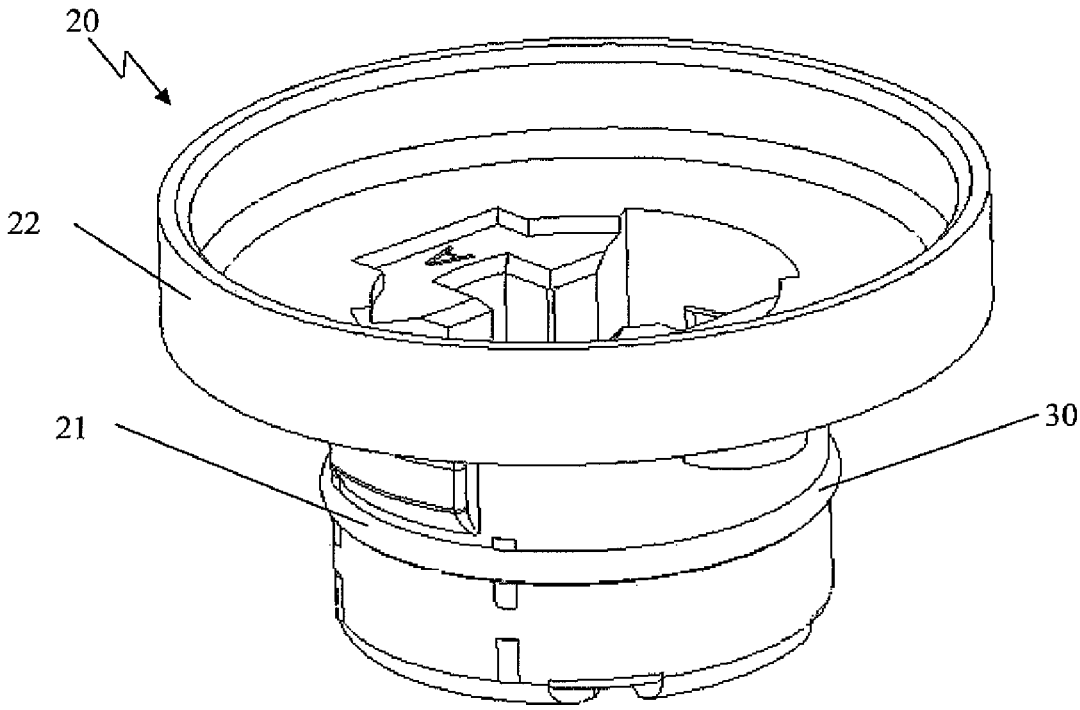
FIG. 5 is a schematic perspective view of the retainer of the electrical connector system according to FIGS. 1 to 4.

In FIG. 5 a schematic perspective view of the retainer 20 of the electrical connector system according to FIGS. 1 to 4 is shown. As can be seen, the bulge like fixing means 21 is not circumferential but only provided on two opposite sides of the outer walls of the retainer. Further, sealing ring 30 and rim 22 are advantageously circular.

Figure 6:
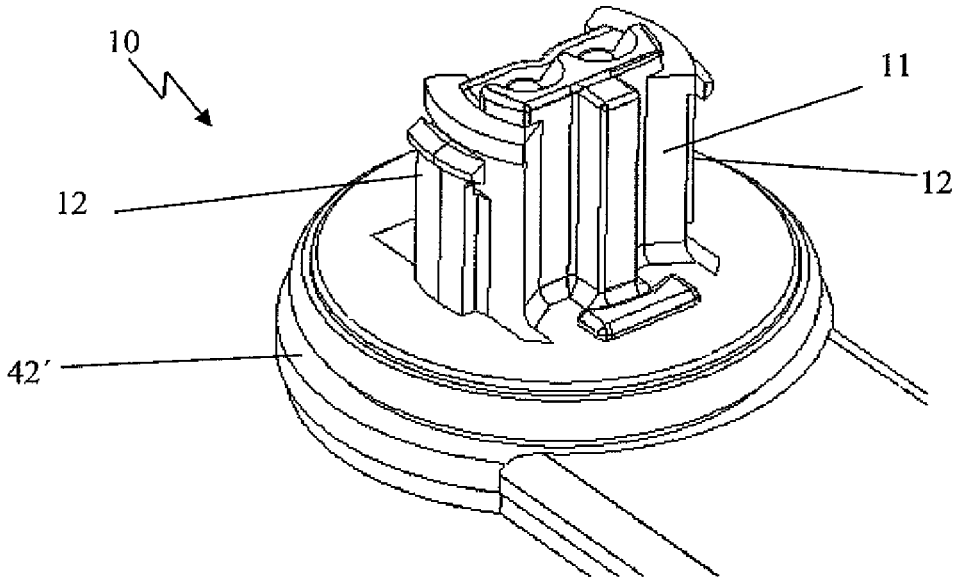
FIG. 6 is a schematic perspective view of a detail of the first connector of the electrical connector system according to FIGS. 1 to 4.

FIG. 6 is a schematic perspective view of the first connector 10 of the electrical connector system according to FIG. 4. In the illustration of FIG. 6 the sealing member is denoted with 42' to indicate that it is an alternative to the sealing member 42. As can be seen on FIG. 6 the outer side of member 42' has advantageously a round cross section. Apart from the portion of connector 10 which is provided with the sealing member 42' the connector shown in FIG. 6 is identical to the connector according to FIGS. 1 to 3. In other words: the plug portion 11 depicted in FIG. 6 is the same in all embodiments described herein. From FIG. 6 it can be seen that the plug portion is provided with two symmetrical arms 12 on two opposing sides thereof.

In all embodiments of the invention, the first and second sealing members are preferably symmetrical ring like members, since this provides a particularly reliable sealing action. In FIG. 4, both the outer wall of the retainer and the inner wall of the connector socket are provided with correspondingly shaped sealing grooves, to at least partially accommodate the first o-ring member 31.

Advantageously, in the embodiments shown in FIGS. 1 to 6, the press fitting of the sealing by means of the first and second sealing members produces an elastic force essentially perpendicular to the insertion direction of retainer and plug portion. This is exemplarily illustrated in FIG. 4, where the first and the second sealing members are slightly compressed and exert an elastic force in a direction essentially perpendicular to the insertion or mating direction, as it is indicated by the arrows on the left side of FIG. 4. Since the elastic forces of the first and second sealing members act perpendicular to the insertion direction of retainer and plug portion, the assembly of retainer and plug portion is not hampered by the sealing members and at the same time, since the sealing members do not produce any substantial force against the insertion direction, the fixing of the different parts of the connector system with each other is not weakened over time by the sealing. Advantageously the sealing members are made of an elastomer material and the body of the first connector and the retainer are of insulating material, e.g. an injected thermoplastic.

The invention claimed is:

1. Electrical connector system comprising:

a first connector provided with a plug-portion;

a retainer adapted to act together with the plug-portion;

the retainer comprises a sleeve portion which is adapted to be arranged in a mating connector socket and which is adapted to receive at least a part of said plug-portion of the first connector therein, and wherein the connector system further comprises a first sealing member adapted to provide a sealing between the sleeve portion of the retainer and inner walls of the mating connector socket; and wherein the connector system comprises a second sealing member, which is adapted to be arranged between the retainer and the first connector to provide a sealing between the retainer and the first connector.

2. Electrical connector system according to claim 1, wherein in correctly assembled condition, walls of the sleeve portion between the first sealing member and the second sealing member does not contain any openings which allow the intrusion of moisture and/or dust into the interior of the sleeve portion.

3. Electrical connector system according to claim 1, wherein the plug portion is provided with at least one resilient latching arm and the sleeve portion is provided in an interior with at least one corresponding latching recess, such that the plug portion may be latched inside of the sleeve portion.

4. Electrical connector system according to claim 1, wherein the sleeve portion is dimensioned such that when it is arranged inside of the mating connector socket it extends from a bottom of the socket to at least an outer rim of the socket.

5. Electrical connector system according to claim 1, wherein the sleeve portion is provided with fixing means on its outside walls adapted to allow a fastening of the sleeve portion inside the mating connector socket.

6. Electrical connector system according to claim 1, wherein the retainer sleeve is essentially cylindrical and the first sealing member is a ring.

7. An assembly comprising:

a first electrical connector provided with a plug-portion;

a retainer connected to the first electrical connector, where the retainer comprises a sleeve portion which is sized and shaped to be inserted into a mating connector socket, where the sleeve portion is sized and shaped to receive at least a part of the plug-portion of the first connector therein;

a first sealing member which is configured to provide a seal between the sleeve portion of the retainer and inner walls of the mating connector socket; and a second sealing member located between the retainer and the first connector to provide a seal between the retainer and the first connector.

* * * * *